United States Patent [19]

Rannou et al.

[11] Patent Number: 4,743,918

[45] Date of Patent: May 10, 1988

[54] ANTENNA COMPRISING A DEVICE FOR EXCITATION OF A WAVEGUIDE IN THE CIRCULAR MODE

[75] Inventors: Jean Rannou, Antony; Emile Pouderous, Boulogne; Pascal Gilbert, Cachan, all of France

[73] Assignee: Thomson-CSF, Paris, France

[21] Appl. No.: 689,848

[22] Filed: Jan. 9, 1985

[30] Foreign Application Priority Data

Jan. 13, 1984 [FR] France ..... 84 00500

[51] Int. Cl.[4] ..... H01Q 1/36

[52] U.S. Cl. ..... 343/895

[58] Field of Search ..... 343/895; 333/21 R, 21 A

[56] References Cited

U.S. PATENT DOCUMENTS

| | | | |
|---|---|---|---|
| 2,746,018 | 5/1956 | Sichak | 333/21 R |
| 2,773,254 | 12/1956 | Engelmann | 343/100 |
| 2,863,145 | 12/1958 | Turner | 343/895 |
| 3,296,620 | 1/1967 | Rodda | 343/895 |
| 3,375,474 | 3/1968 | Thompson et al. | 333/21 R |
| 3,568,206 | 3/1971 | Sisson et al. | 343/895 |
| 3,623,118 | 11/1971 | Monser et al. | 343/895 |
| 3,757,345 | 9/1973 | Carver | 343/786 |
| 4,011,566 | 3/1977 | Honda | 343/785 |
| 4,319,248 | 3/1982 | Flam | 343/701 |

OTHER PUBLICATIONS

Supplement to IEEE Transactions on Aerospace, vol. AS-3, No. 2, Jun. 1965, The Institute of Electrical and Electronics Engineers, Inc., New York . . . .

*Primary Examiner*—William L. Sikes
*Assistant Examiner*—Robert E. Wise
*Attorney, Agent, or Firm*—Roland Plottel

[57] ABSTRACT

A device for waveguide excitation in circular polarization comprising a microwave feed line along which a transverse electromagnetic wave travels, a waveguide and a radiating element fed by the line for radiating a wave which excites the waveguide in circular polarization.

10 Claims, 1 Drawing Sheet

ANTENNA COMPRISING A DEVICE FOR EXCITATION OF A WAVEGUIDE IN THE CIRCULAR MODE

BACKGROUND OF THE INVENTION

1. Field of the Invention

The present invention relates antennae comprising device for exciting waveguides in the circular mode.

2. Description of the Prior Art

In order to excite a circular waveguide from a microwave line, it is necessary to change the mode of propagation of the wave transmitted by the line.

In fact, in microwave lines which are in current use such as coaxial lines, two-wire, three-plate or microstrip lines, the mode of propagation of waves is a transverse electromagnetic mode (TEM mode).

The mode of propagation of waves within a waveguide is a transverse electric (TE) mode or a transverse magnetic (TM) mode.

The preferential mode of excitation of a circular waveguide is the circular mode (TE 11 or TM 11).

In order to change from a TEM mode to a mode guided in circular polarization within a circular waveguide, two solutions are already known.

In a first solution, the initial step consists in carrying out an electric coupling. This coupling permits a transition from the TEM mode to the TE 10 mode in a rectangular waveguide. The second step consists in carrying out a coupling by transition in order to change-over to the TE 11 (rectilinear) mode in a circular waveguide. It is then necessary to change-over from the TE 11 mode to a circular mode. This coupling operation is usually performed by a polarization rotator of the iris type or dielectric-plate type.

The second solution consists in coupling the circular waveguide by means of two probes disposed at right angles. The probes are fed by waves of equal amplitude having a phase shift of $\pi/2$ and transmitted by microwave line. The phase shift can be carried out prior to feeding of the probes, in which case said probes are located in the same plane. The phase shift within the waveguide can take place by relative displacement of the probes by a wavelength equal to $(\lambda g)/4$ where $\lambda g$ is the guided wave length.

The two known solutions are usually complex and the excitation devices obtained are bulky, particularly in the case of the first solution.

In both cases of the second solution, the polarization rotator must be fed by two channels having the same power. It is therefore necessary to make use of a power divider which is capable of producing an equitable energy distribution in each channel.

In the first case of the second solution, a phase-shifter is usually adopted for the purpose of phase-shifting the probes which feed the waveguide.

Apart from the disadvantages which arise from complexity and bulk, a third additional disadvantage arises from the passband of the device since it is usually narrow and consequently ill-suited for many applications which require a very large bandwidth. One known solution, however, permits an increase in width of the passband by making use of a so-called "orthogonal double ridge" waveguide. This waveguide is machined so as to have longitudinal recessed portions which result in a waveguide having a channeled cross-section. The manufacture of waveguides of this type is clearly more complex than in the case of ordinary waveguides and consequently entails higher capital cost.

SUMMARY OF THE INVENTION

The object of the present invention is to overcome these drawbacks by proposing an antenna comprising a device for waveguide excitation in circular polarization comprising an antenna which produces unidirectional radiation in circular polarization and is fed directly by a microwave line. Said antenna has dimensions which are adapted to ensure that the emitted radiation excites the waveguide and the passband of the waveguide is of substantial width since it is now limited only by the cutoff frequency of the waveguide.

The invention is therefore directed to a device for waveguide excitation in circular polarization which is mainly distinguished by the fact that it comprises a microwave feed line along which a transverse electromagnetic wave (TEM wave) travels, a waveguide and a radiating element fed by the line and capable of radiating a wave for exciting the waveguide in circular polarization.

BRIEF DESCRIPTION OF THE DRAWINGS

Other features of the invention will be more apparent upon consideration of the following description and accompanying drawings, wherein.

DESCRIPTION OF THE PREFERRED EMBODIMENTS

Figure 1:
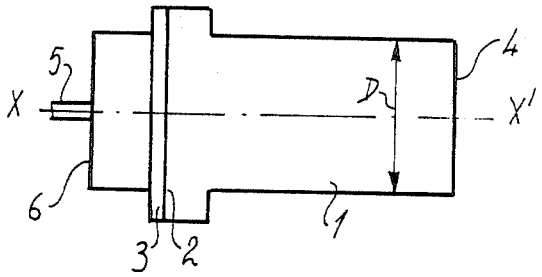
FIG. 1 illustrates an excitation device in circular mode in accordance with the invention.

The device for waveguide excitation in the circular mode as shown in FIG. 1 permits a direct transition from a transverse electromagnetic mode (TEM mode), which is the conventional mode of propagation in microwave lines, to a guided mode in circular polarization. This device comprises a circular waveguide 1 having a longitudinal axis X—X' and a diameter D determined as a function of the desired cutoff wavelength $\lambda_C$. One end 2 which will be referred-to as the entrance end is placed in front of a radiating element 3 whereas the other end 4 which will be referred-to as the exit end is open.

The radiating element 3 is constituted by an antenna which emits unidirectional radiation in circular polarization when it is fed with a transverse electromagnetic (TEM) wave. The feed is performed by means of a microwave line 5. Said line 5 can be a coaxial line, a two-wire line or a microstrip line.

The exciting antenna or radiating element 3 therefore emits a circularly polarized wave in the direction of the exit aperture 4. A cavity 6 placed against the radiating element 3 upstream of this latter and in the line of extension of the waveguide constitutes a reflecting plane which makes it possible to obtain unidirectional radiation from the radiating element 3.

Figure 2:
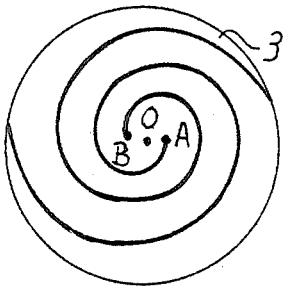
FIGS. 2 and 3 illustrate a radiating element as shown in FIG. 1, in a first and second embodiment of said element.

FIG. 2 illustrates one example of construction of a radiating element 3 in circular polarization. This element is a conventional double logarithmic spiral or so-called equiangular spiral antenna. However, an Archimedes' spiral or a multispiral antenna would also be suitable. The antenna is designed on the basis of a given center of expansion 0 and a given expansion coefficient $\tau$. The feed takes place on the points A and B, the two arms of the antenna are fed in phase opposition in order to obtain a maximum field in the direction X—X'. The antenna is placed in front of the plane reflector 6 shown in FIG. 1 in order to produce unidirectional radiation. The length of one arm establishes the lowest frequency whilst the width AB establishes the highest frequency. The passband of this type of antenna is of substantial width.

Figure 3:
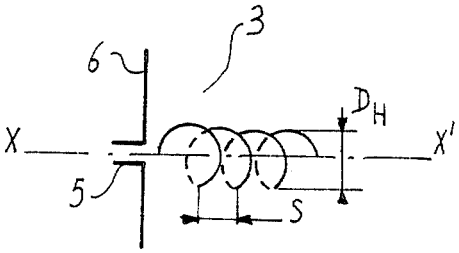

FIG. 3 shows another example of construction of a radiating element 3. In this case the antenna is of the helical type having dimensions which are chosen so as to ensure that the helix radiates axially in circular polarization. The conditions to be satisfied in regard to the choice of length, diameter and pitch of each turn of the helix in order to obtain unidirectional radiation are already known. In this embodiment, a reflector is not essential for the purpose of obtaining the unidirectional effect but is necessary for matching the feed line 5. By way of example, the radiating element 3 can be fed by a coaxial line 5, the sheath of which is connected to the reflector 6.

It will be readily understood that, in the two examples of construction considered in the foregoing, the dimensions of the radiating elements (antennas) must be compatible with those of the waveguide to be excited by these latter in order to ensure that the radiation takes place entirely within the waveguide without attenuation. With this objective, the wavelengths must be shorter than the cutoff wavelength $\lambda_C$, thus resulting in a passband $f_C - f_M$, where $f_M$ is dependent solely on the exciting antenna element 3. Since these antennas have a very wide passband, the device itself has a very wide passband.

The cutoff wavelength $\lambda_C$ of a circular waveguide in the circular polarization mode (TE 11 mode) is determined by the following relation (1) :

$$\lambda_C = 1.7 \times D \quad (1)$$

where D is the waveguide diameter.

The mean diameter $D_m$ defined by the diameter of the radiation zone of a spiral antenna is given by the following relation (2) :

$$D_m = \lambda/\pi \quad (2)$$

where $\lambda$ is the wavelength of the radiated wave.

It is therefore observed that, in the case of wavelengths shorter than $\lambda_C$, the diameter $D_m$ is always shorter than the diameter D. The radiation therefore takes place entirely within the waveguide up to cutoff as long as the frequencies remain higher than the cutoff frequency of the waveguide. The choice of a spiral antenna for exciting a circular waveguide in circular polarization is wholly compatible with relation (1).

In the case of the helix antenna, the helix pitch S is chosen so as to be smaller than $(\lambda o)/2$ (where $\lambda o$ corresponds to $f_o$, midband frequency) as well as a diameter $D_H$ such that the length of the circumference $C_H$ is within the range of 0.7 $\lambda o$ to 1.7 $\lambda o$, $D_H$ being consequently within the range of 0.22 $\lambda o$ to 0.45 $\lambda o$. The result of this choice is that the phase shift between radiating points located identically on adjacent turns of the helix satisfies the condition of longitudinal radiation, thus making it possible to obtain maximum radiation in the axis X—X'. It is found as in the previous case that $D_H$ is always lower than D.

Figure 4:
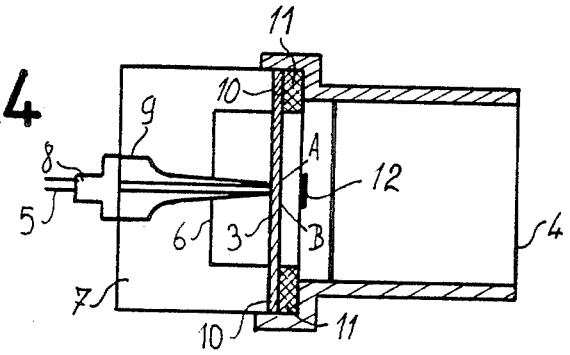
FIG. 4 illustrates an antenna in accordance with FIG. 1.

FIG. 4 illustrates an application of the antenna with the waveguide excitation device shown in cross-section. In this application, the radiating element 3 is constituted by a double logarithmic spiral or so-called equiangular spiral antenna which is printed on a substrate, for example. The support provided for said radiating element 3 can also serve as a support for the microelectronic components employed in specific applications. It is in fact an easy matter to place a detecting diode between the points A and B of the double spiral and thus to perform the detecting function at the receiving point. Pin diodes can be placed between the two arms and at a short distance from the center in order to produce a modulation of the signal received by the antenna. It is also possible to place capacitors in series on each arm between the center and the pin diodes so as to permit decoupling between the modulation current and the detected voltage.

A connecting device 7 is placed behind the cavity 6. This device makes it possible to connect a coaxial line 5 to the exciting antenna element 3. The connecting device 7 comprises a coaxial connector 8 and an impedance-matching device 9 which permits a progressive transition from a coaxial line to a microstrip line and then to a two-wire line. The two-wire line feeds the exciting antenna directly at the points A and B.

The radiating element 3 of the antenna assembly is packed at the ends 10 of said element with an absorber 11 which is applied against the support circuit of the antenna assembly in order to absorb non-radiated energy.

The exit end 4 of the waveguide thus constitutes a radiating aperture.

In order to improve the impedance-matching efficiency of the waveguide antenna assembly, a metal disk 12 is interposed at the entrance end of the waveguide and at the center of this latter, at a distance d in the vicinity of $\lambda o/10$ from the exciting antenna element, where $\lambda o$ corresponds to the wavelength of the center frequency $f_o$ of the operating passband of the waveguide antenna assembly.

Figure 5:
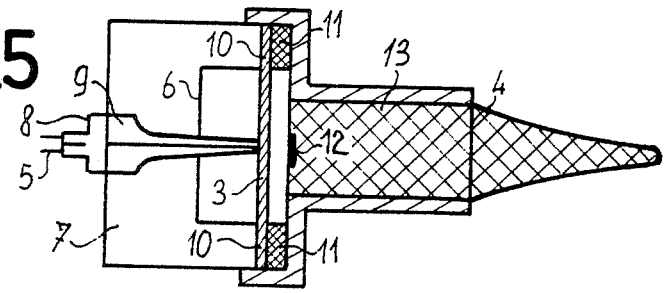
FIG. 5 illustrates an alternative embodiment of antenna in accordance with FIG. 4.

FIG. 5 illustrates an alternative embodiment of the device shown in FIG. 4. The waveguide antenna assembly shown in cross-section in this figure is identical with the assembly shown in FIG. 4 except for the fact that the waveguide is filled with dielectric material 13 having a dielectric constant higher than 1. The medium in which the waves propagate is modified and permits a reduction in dimensions of the waveguide. The shape of the dielectric at the exit end of the waveguide is chosen so as to conform to the pre-established radiation diagram. This shape is also chosen so as to obtain an aerodynamic configuration which is compatible with the location of the waveguide antenna assembly. There is shown in this figure a cone-shaped dielectric antenna which is perfectly compatible with a location on board an aircraft, for example.

The waveguide antenna assembly shown in FIG. 5 has an advantage in that it offers the same characteristics as the assembly shown in FIG. 4 while being of smaller overall size since the waveguide proper has small dimensions. This alternative embodiment offers the further advantage of obtaining protection against external stresses on the waveguide and thus providing the same functions as those of a radome.

In conclusion, the antenna in accordance with the invention comprises a little cumbrous device for waveguide excitation in circular polarization permitting direct transition from a transverse electromagnetic mode of polarization to a circular polarization mode, said antenna can so emit waves in circular polarization and wide band. With this end in view, the radiating element 3 in circular polarization thus employed excites the waveguide in the circular mode and is fed from a microwave line 5 in which the propagation mode is the transverse electromagnetic (TEM) mode. In consequence, the passband of the device is determined on the one hand by the passband of the exciting antenna or radiating element 3 and on the other hand by the cutoff frequency of the waveguide. The aperture of the waveguide serves as a radiating element and the waveguide serves as a high-pass filter. In the event that the radiating element 3 is a double-spiral antenna, this antenna can be employed as a support for microelectronic components.

What is claimed is:

1. An antenna system comprising a circular wave guide having first and second ends, radiating means having an input end and comprising a double spiral conductor positioned outside and adjacent the first end of the wave guide for exciting unidirectionally said wave guide with wave energy of circular polarization for travel through said wave guide and exiting at its second end, and transmission line means for supplying electromagnetic wave energy in a transverse electromagnetic mode to the input end of said radiating means.

2. An antenna system according to claim 1 in which the double spiral conductor is a conductive pattern on a substrate.

3. An antenna system according to claim 2 in which the substrate further provides a support for microelectronic components.

4. An antenna system in accordance with claim 2 in which the double spiral conductor comprises a pair of spiral elements in a commom plane, each spiral element forming a single turn and having an input inner end to which is fed energy from the transition line means, the two input ends of the pair of spiral elements being positioned on diametrically opposite sides of the longitudinal axis of the circular wave guide and being fed in phase opposition from said transmission line.

5. An antenna system in accordance with claim 4 in which said double spiral conductor is a conductive pattern on a planar substrate.

6. The antenna system of claim 4 in which the spacing between the input ends of the two spiral elements is chosen to establish the highest frequency and the length of each element the lowest frequency of the operating passband.

7. An antenna system in accordance with claim 1 which further includes absorption means positioned in front of said radiating means for absorbing non-radiated wave energy.

8. An antenna system in accordance with claim 7 which further includes means resonant at high frequencies positioned opposite a central front portion of the radiating means.

9. An antenna system in accordance with claim 8 wherein the interior of the waveguide is filled with dielectric material and the second end of the wave guide is designed to be a radiating aperture.

10. An antenna system in accordance with claim 9 which further includes a substrate on which is deposited a conductive pattern for providing the double spiral conductor and electronic components.

* * * * *